United States Patent [19]

Sadahiro

[11] Patent Number: 4,577,995

[45] Date of Patent: Mar. 25, 1986

[54] MECHANISM FOR GENERATING VIBRATIONS FOR A GROUND COMPACTING MACHINE

[75] Inventor: Hisanori Sadahiro, Kawagoe, Japan

[73] Assignee: Sakai Heavy Industries Ltd., Tokyo, Japan

[21] Appl. No.: 596,278

[22] Filed: Apr. 3, 1984

[30] Foreign Application Priority Data

Apr. 7, 1983 [JP] Japan ..... 58-61408

[51] Int. Cl.[4] ..... E01C 19/38

[52] U.S. Cl. ..... 404/117; 404/130; 172/40; 74/87

[58] Field of Search ..... 404/103, 117, 122, 130; 74/61, 87; 209/367; 366/128; 37/DIG. 18; 172/40; 173/49

[56] References Cited

U.S. PATENT DOCUMENTS

| | | | |
|---|---|---|---|
| 3,415,174 | 12/1968 | Kaltenegger | 404/117 |
| 3,778,177 | 12/1973 | Haker et al. | 404/117 |
| 4,152,943 | 5/1979 | Wall | 404/117 X |
| 4,219,287 | 8/1980 | Marks | 404/117 |

FOREIGN PATENT DOCUMENTS

| | | | |
|---|---|---|---|
| 52115 | 8/1936 | Denmark | 404/130 |
| 822979 | 10/1951 | Fed. Rep. of Germany | 74/61 |

*Primary Examiner*—James A. Leppink
*Assistant Examiner*—John F. Letchford
*Attorney, Agent, or Firm*—Cushman, Darby & Cushman

[57] ABSTRACT

An improved mechanism for generating vibrations in the horizontal plane for a ground compacting machine is disclosed. At least a rotary shaft with an eccentric mass mounted for generating required vibrations is rotatably supported within the rolling wheel. The rotary shaft adapted to be rotated by a hydraulic motor assumes the position where its center line of rotation is located on a linear line radially extending from the center line of rotation of the rolling wheel. Rotation of the hydraulic motor is usually transmitted to the rotary shaft for the eccentric mass via bevel gears. Typically, an opposing pair of rotary shafts are disposed opposite to one another relative to the center line of rotation of the rolling wheel. Three or more rotary shafts may be disposed in such a manner that their eccentric masses are distributed so as to assure good weight balance. The center line of rotation of the rotary shaft may be located in parallel with a linear line radially extending from the center line of rotation of the rolling wheel. The rotary shafts may assume the position where their center lines are located in the spaced relation in the axial direction of the center line of rotation of the rolling wheel. The rolling wheel made of steel plate is preferably covered with a layer of rubber coating.

6 Claims, 6 Drawing Figures

MECHANISM FOR GENERATING VIBRATIONS FOR A GROUND COMPACTING MACHINE

BACKGROUND OF THE INVENTION

1. Field of the Invention

The present invention relates to a mechanism for generating vibrations for a ground compacting machine and more particularly to improvement of or relative to a mechanism for generating vibrations in the horizontal plane for a ground compacting machine of the type including a rolling wheel.

2. Description of the Prior Art

A conventional ground compacting machine is generally constructed such that an eccentric mass is fixedly mounted on a rotary shaft extending along the center line of rotation of the rolling wheel to vibrate the latter in the vertical direction by rotating the rotary shaft. However, it has been pointed out as a drawback inherent to the conventional ground compacting machine that vertical vibrations are adversely transmitted to living houses, manufacturing facilities or the like in the neighborhood and thereby they are vibrated unpleasantly. Another drawback of the conventional ground compacting machine is that working energy produced by vertical vibrations is uselessly absorbed in a layer of rubber coating on the rolling wheel.

SUMMARY OF THE INVENTION

Thus, the present invention has been made with the foregoing drawbacks in mind.

It is an object of the present invention to provide an improved mechanism for generating vibrations for a ground compacting machine which can minimize adverse influence on building, facilities or the like in the neighborhood by vibrating the rolling wheel in the horizontal plane.

It is other object of the present invention to provide an improved mechanism for generating vibrations for a ground compacting machine which assures that ground compacting operation is performed without occurrence of hair cracks on the ground at a high operational efficiency.

It is another object of the present invention to provide an improved mechanism for generating vibrations for a ground compacting machine which assures that ground rolling operation is performed even on the inclined ground having a considerably high inclination angle owing to increased frictional force between the rolling wheel and the inclined ground.

To accomplish the above objects there is proposed in accordance with the present invention a mechanism for generating vibrations in the horizontal plane for a ground compacting machine of the type including a rolling wheel, wherein the improvement consists in that at least a rotary shaft with an eccentric mass fixedly mounted thereon is rotatably supported in the rolling wheel in such a manner that the center line of rotation of the rotary shaft is located on a linear line extending in parallel to the radial direction relative to the center line of rotation of the rolling wheel whereby the ground contact portion on the rolling wheel is vibrated in the horizontal plane by rotating the rotary shaft for the eccentric mass.

Usually, an opposing pair of rotary shafts are disposed opposite to one another relative to the center line of rotation of the rolling wheel.

Three or more rotary shafts may be arranged in the rolling wheel. In this case their position should be determined such that eccentric masses are distributed so as to keep good weight balance within the rolling wheel.

Normally, the rotary shaft(s) assume the position where center lines of rotation are located on radial line(s) extending outwardly from the center line of rotation of the rolling wheel.

In case where a plurality of rotary shafts are disposed in the rolling wheel, they may assume the position where their center lines of operation are located in the spaced relation in the axial direction of the center line of rotation of the rolling wheel.

The rolling wheel made of steel plate is preferably covered with a layer of coating of elastomeric material such as rubber or the like.

Other objects, features and advantages of the invention will become more clearly apparent from reading of the following specification which has been prepared in conjunction with the accompanying drawings.

BRIEF DESCRIPTION OF THE DRAWINGS

It should be noted that same or similar parts or components throughout the drawings are identified by the same reference numerals.

DETAILED DESCRIPTION OF THE PREFERRED EMBODIMENTS

Now, the present invention will be described in a greater detail hereunder with reference to the accompanying drawings which schematically illustrate a few preferred embodiments thereof.

Figure 1:
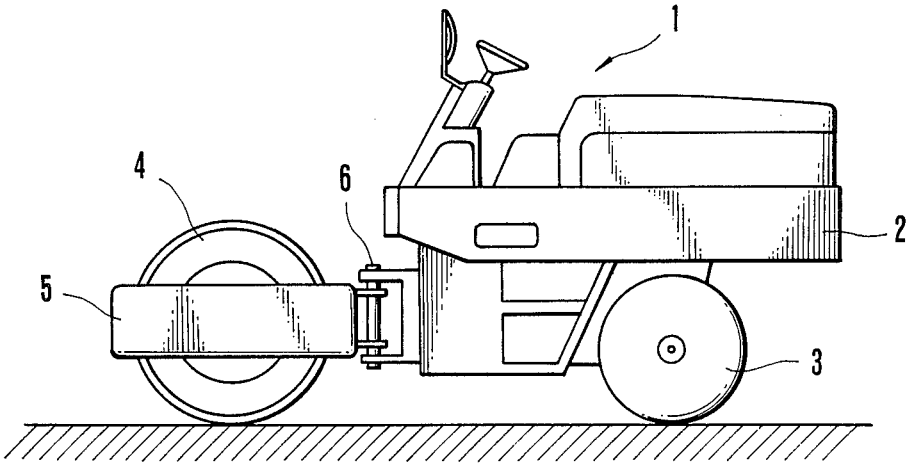
FIG. 1 is a side view of a ground compacting machine with a vibrating mechanism of the invention mounted thereon.

Referring first to FIG. 1, a ground compacting machine 1 on which a mechanism for generating vibrations is mounted is exemplified by way of a side view. In the drawing reference numeral 2 designates a chassis on which a prime mover, a driving unit, a steering unit and an operator's seat are arranged in the hitherto known manner. Further, the chassis 2 is operatively connected to a frame 5 via a junction pin 6, said frame 5 having a rolling wheel 4 rotatably mounted thereon.

A mechanism for generating vibrations (hereinafter referred to as vibrating mechanism) in accordance with the first embodiment of the invention is schematically illustrated by way of a sectional view in FIG. 2. The frame 5 has an opposing pair of side plates each of which is integrally formed with an axle 7 inside the side plate. A fitting member 9 is resiliently held within each of the axles 7 with a suspension rubber 8 interposed therebetween.

On the other hand, the rolling wheel 4 has an opposing pair of side plates 10 at the position located in the proximity of the innermost end part of an axial extension of the fitting members 9 and each of the side plates 10 has an axial extension 11 which is rotatably supported within the axial extension of the fitting member 9 with two ball bearings 12 disposed therebetween. Thus, the rolling wheel 4 is rotatably supported within the frame 5 via the axles 7, the suspension rubbers 8, the fitting members 9, the axial extensions of the latter, the ball bearings 12, the axial extensions 11 of the side plates 10 and the latter.

A reversible hydraulic motor 13 is fixedly fitted to the righthand fitting member 9 as seen in the drawing and its output shaft is operatively connected to a shaft 15 for a bevel gear 14 via a coupling, said shaft 15 being rotatably held within the axial extension 11 with the aid of two ball bearings 16.

On the other hand, an opposing pair of rotary shafts 17A and 17B are rotatably disposed by means of two pair of ball bearings 18 inside the side plate 10 of the rolling wheel 4 in such a manner that they are located in axial alignment with one another along the center line B of rotation which extends at a right angle relative to the center line A of rotation of the rolling wheel 4. The rotary shafts 17A and 17B have bevel gears 19A and 19B fixedly secured to the innermost end part thereof, said bevel gears 19A and 19B meshing with the bevel gear 14 on the shaft 15 of the hydraulic motor 13. Further, the rotary shafts 17A and 17B have eccentric masses 20A and 20B fixedly secured to the outermost end part thereof. The positional relation between the eccentric masses 20A and 20B is determined such that they are located eccentrical relative to the center line B of rotation in the same direction as seen from the latter and moreover they are located diametrically opposite to one another relative to the center line A of the rolling wheel 4. It should be noted that the rolling wheel 4 is constructed such that its body **4*a* made of steel plate is covered with a layer of rubber coating 4*b*** over the outer surface thereof.

Next, operation of the vibrating mechanism as constructed in the above-mentioned manner will be described below.

Figure 2:
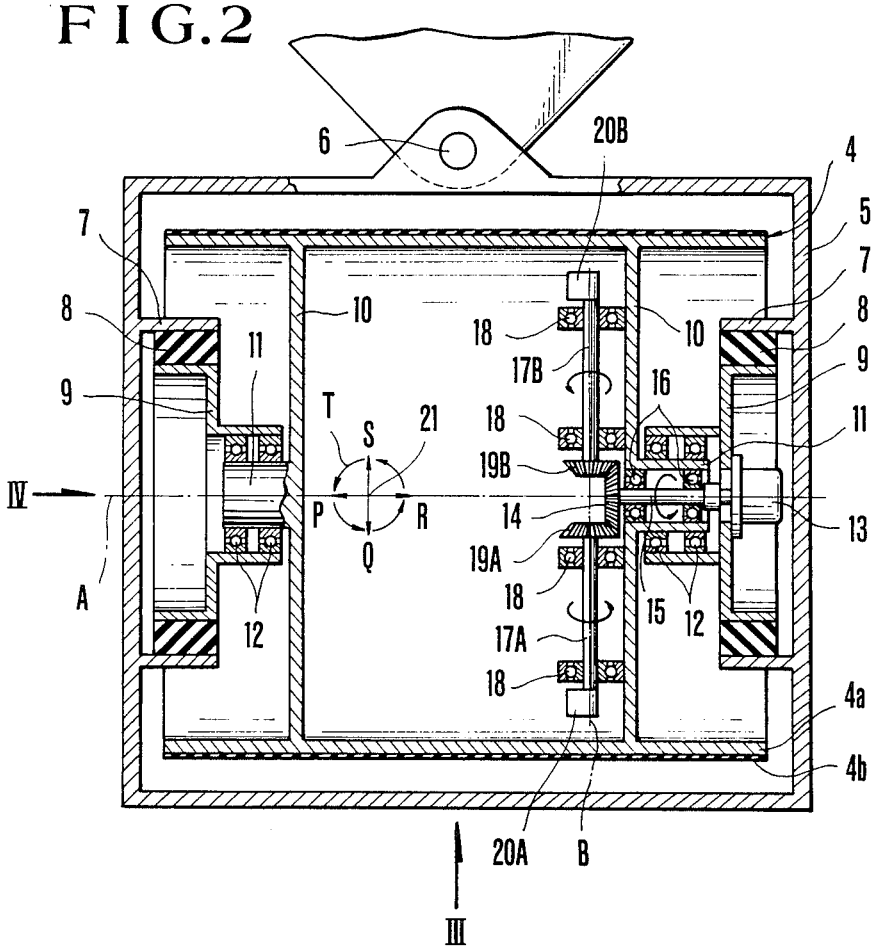
FIG. 2 is a sectional view of the vibrating mechanism in accordance with the first embodiment of the invention.
Figure 3:
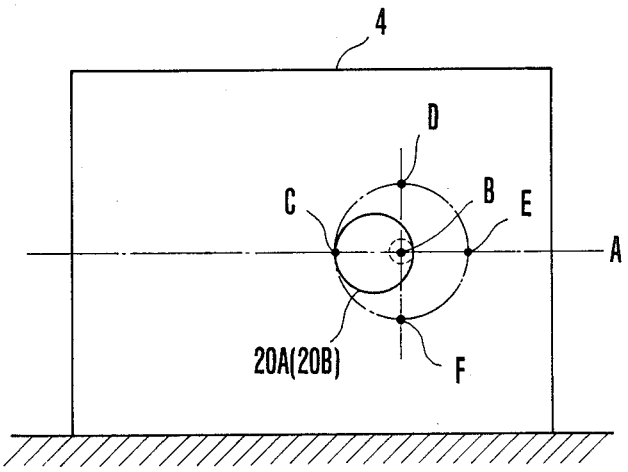
FIG. 3 is a front view of the vibrating mechanism as seen in the direction as identified by an arrow III in FIG. 2.

When the rotary shafts 17A and 17B are rotated in the direction as identified with arrows by operating the hydraulic motor 13 while the ground compacting machine 1 stops its movement, the position of the eccentric mass 20A is circularly shifted in the order of C, D, E and F and that of the eccentric mass 20B is circularly shifted in the order of C, F, E and D, as illustrated in FIG. 3. When the eccentric mass 20A passes through the position C during its circular movement, the eccentric mass 20B does through the position C whereby there is produced force which is exerted on the rolling wheel 4 in the direction as oriented from the center position B toward the position C in FIG. 3. This force is identified by reference letter P in FIG. 2. Further, when the eccentric mass 20A passes through the position E during its circular movement, the eccentric mass 20B does also through the position E in the same manner as in the foregoing case whereby there is produced force which is exerted on the rolling wheel 4 in the direction as oriented from the center position B toward the position E in FIG. 3. This force is identified by reference letter R in FIG. 2.

Figure 4:
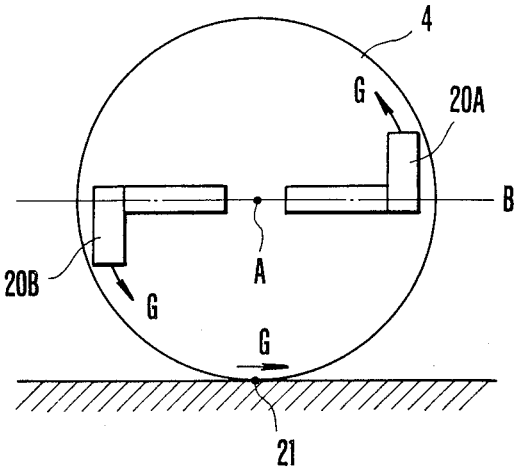
FIG. 4 is a side view of the vibrating mechanism as seen in the direction as identifies by an arrow IV in FIG. 2.

On the other hand, when the eccentric mass 20A passes through the position D during its circular movement, the eccentric mass 20B does through the position F whereby there is produced force which is effective on the rolling wheel 4 in the direction as identified by reference letter G in FIG. 4. This causes force to be produced on the ground contact portion 21 of the rolling wheel 4, said force being oriented in the direction parallel to the ground surface. This force is identified by reference letter Q in FIG. 2. Further, when the eccentric mass 20A passes through the position F during its circular movement, the eccentric mass 20B does through the position D whereby there is produced force which is effective at the ground contact portion 21 of the rolling wheel 4 for rotating the latter, said force being oriented in the opposite direction to the foregoing force Q.

As is apparent from the above description, there is produced force as identified by reference letters P, Q, R and S in FIG. 2 which is exerted on the rolling wheel 4 at the ground contact portion 21, that is, force of which radial direction relative to the center position B is continuously changed as the eccentric masses 20A and 20B are rotated. Thus, this force causes the ground contact portion 21 to be vibrated in the horizontal plane in the momentarily variable direction as represented by an arrow T in FIG. 2.

On the other hand, when the eccentric masses 20A and 20B are rotated while the ground compacting machine 1 is moving, it results that the ground contact portion of the rolling wheel is subjected to composite vibration composed of vibration in the horizontal plane due to rotation of the eccentric masses 20A and 20B and vibration due to forward or backward movement of the ground compacting machine 1.

Thus, when ground compacting operation is performed by actuating the vibrating mechanism of the invention in which the eccentric masses 20A and 20B are rotated, earth, gravel or the like below the ground contact portion 21 of the rolling wheel 4 is circularly rocked or kneaded irrespective of whether the ground compacting machine 1 is moving or not. As a result, ground compacting is accomplished without any occurrence of hair cracks at a remarkably improved operational efficiency.

Further, since ground compacting is effected also in the horizontal direction, higher vibration damping effect is assured for the ground than when ground compacting operation is performed merely by vertical vibration as is the case with the conventional ground compacting machine. Therefore, rolling operation can be performed with the minimized vibration in an area located in the proximity of facilities for which ground vibration should be inhibited or on a public road along which a number of living houses are located.

Further, due to the fact that horizontal vibration is also generated by the vibrating mechanism of the invention higher frictional force is assured for the rolling wheel 4 than in case when only vertical vibration is generated by the conventional vibrating mechanism. This advantageous feature makes it possible to carry out rolling operation while moving up or down on the inclined ground having a considerably high inclination.

Since a characterizing feature that the rolling wheel 4 is covered with a layer of rubber coating is combined with another characterizing feature that vibration is generated also in the horizontal direction by operating the vibrating mechanism of the invention, increased frictional coefficient can be obtained between the ground contact portion of the rolling wheel and the ground surface whereby compacting operation as well as rolling operation are performed on the ground surface having a number of fine recesses formed thereon at an improved operational efficiency because vibration is exerted directly on these recesses.

Another advantageous feature of the invention is that since the rolling wheel 4 is covered with a layer of rubber coating, finish rolling operation is performed for the ground paved with asphalt compounded material with the minimized flow of compounded material and inhibition of occurrence of carcks, resulting in beautiful surface finishing achieved.

The present invention has been described above with respect to the first embodiment but it should of course be understood that it should not be limited only to this but various changes or modifications may be made without any departure from the spirit and scope of the invention as defined in the appended claims. For instance, rotary shafts for eccentric masses may be mounted on brackets which are fitted to the inner circumferential surface of the rolling wheel at different positions from the side plate. In the illustrated embodiment the center line B of rotation of the rotary shafts for the eccentric masses extends at a right angle relative to the center line A of rotation of the rolling wheel to intersect with the latter but the present invention should not be limited only to this. Alternatively, the center line B of rotation of the rotary shafts for the eccentric masses may extend along a linear line in parallel with the radial direction relative to the center line A of rotation of the rolling wheel (including the case where it extends along any radial direction as seen from the center line A of rotation of the rolling wheel). Consequently, the center line of rotation of the rotary shafts may extend in any direction, unless it extends along the center line A of rotation of the rolling wheel or in parallel with the same. It should be noted that all modifications with respect to the direction of extending of the center line B of rotation of the rotary shafts as described above should be considered within the scope of the invention. Specifically, rotational force of the hydraulic motor 13 can be effectively converted into force for generating vibrations in the horizontal plane, as long as an angle formed between the center line B of rotation of the rotary shafts and the center line A of rotation of the rolling wheel is determined in the range of 30 to 90 degrees and preferably in the range of 45 to 90 degrees. Further, the center line B of rotation of the rotary shafts for the eccentric masses may extend along a linear line which does not pass through the center of rotation of the rolling wheel but this case should be considered within the scope of the invention. It is found that effective force for generating vibrations in the horizontal plane can be produced, as long as the center line B of rotation of the rotary shafts for the eccentric masses extends through the position which is spaced from the center of rotation of the rolling wheel by a distance shorter than one fourth of the diameter of the rolling wheel.

In the illustrated embodiment the present invention has been described with respect to the case where the vibrating mechanism includes two rotary shafts but it should not be limited only to this. Alternatively, the vibrating mechanism may include a single rotary shaft without fear of failing to generate vibrations in the horizontal plane. Further, it may include three or more rotary shafts which are arranged in the equally spaced relation as seen in the circumferential direction of the rolling wheel while eccentric masses are distributed so as to assure good weight balance. When it includes two or more rotary shafts, they may be located in the spaced relation in the axial direction of the rolling wheel. When it includes a plurality of rotary shafts, they may be located such that circular or circulative vibrations generated by eccentric masses on the rotary shafts are superimposed each other to produce amplified circular or circulative vibration or they may be located such that circular or circulative vibrations generated by some eccentric masses in a certain direction are cancelled each other but those generated by other eccentric masses in another direction are superimposed each other.

Figure 5:
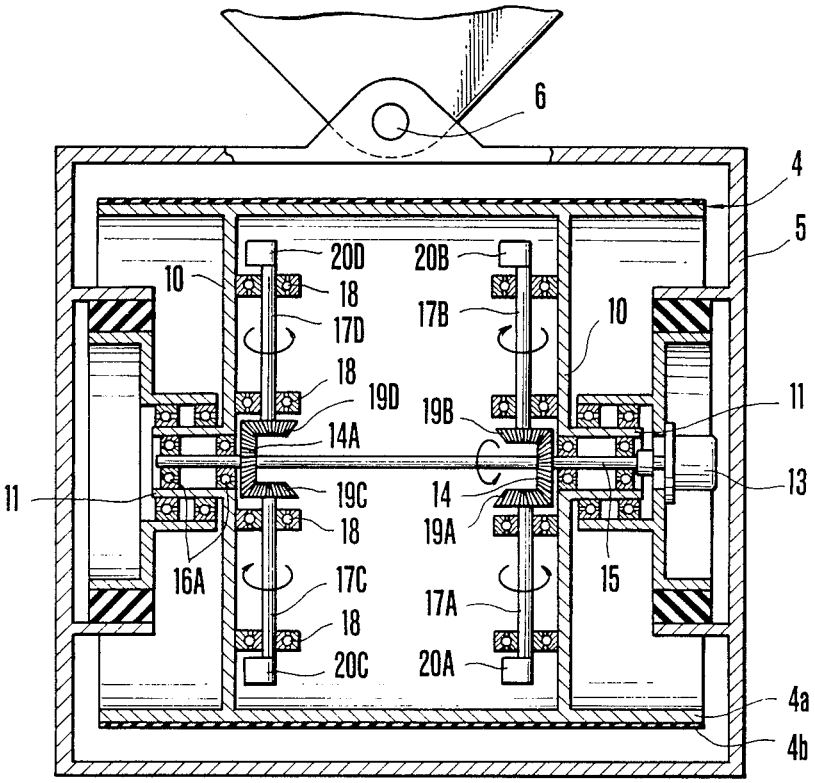
FIG. 5 is a sectional view of the vibrating mechanism in accordance with the second embodiment of the invention.
Figure 6:
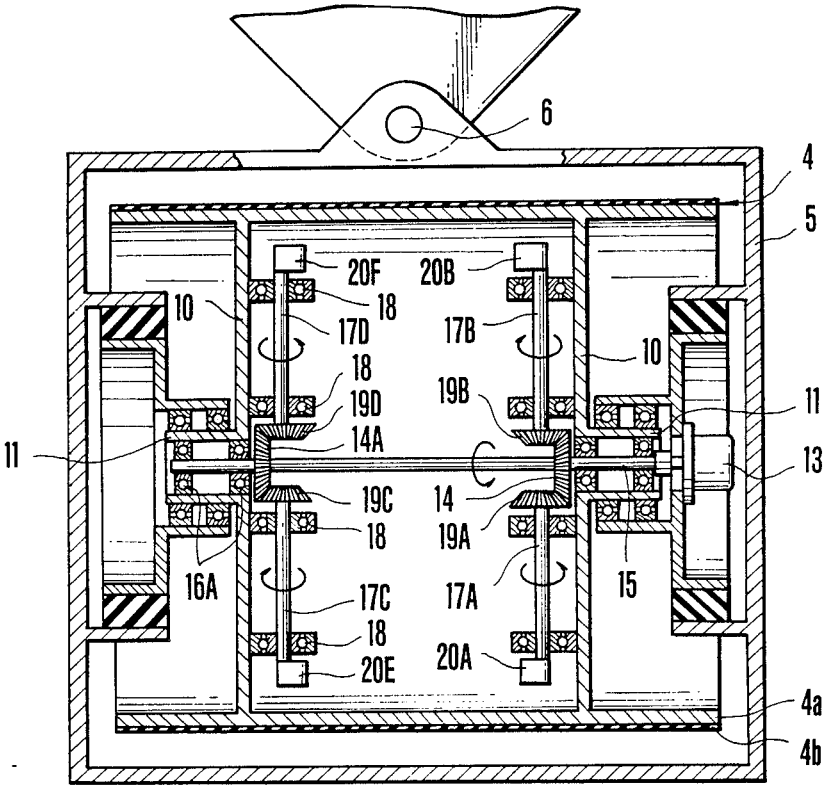
FIG. 6 is a sectional view of the vibrating mechanism in accordance with the third embodiment of the invention.

Next, a vibrating mechanism in accordance with the second embodiment of the invention is schematically illustrated by way of a sectional view in FIG. 5 and a vibrating mechanism in accordance with the third embodiment is schematically illustrated also by way of a sectional view in FIG. 6. Same or similar parts or components to those in FIG. 2 are identified by the same reference numeral and their repeated description will not be required. In both the embodiments the shaft 15 has an axial extension which is rotatably supported by means of two ball bearins 16A and includes a bevel gear 14A fixedly mounted thereon. The bevel gear 14A meshes with bevel gears 19C and 19D which are fixedly mounted on the innermost end parts of rotary shafts 17C and 17D rotatably supported by means of two pair of ball bearings 18 inside the lefthand side plate 10 as seen in the drawings.

In the embodiment as illustrated in FIG. 5 eccentric masses 20A and 20B on the rotary shafts 17A and 17B are located in the same phase as that of eccentric masses 20C and 20D on the rotary shafts 17C and 17D. As the rotary shafts 17A, 17B, 17C and 17D are rotated by means of the hydraulic motor 13, circular movement in the horizontal plane caused by rotation of the eccentric masses 20A and 20B cooperates with circular movement in the horizontal plane caused by rotation of the eccentric masses 20C and 20D in such a manner that vibrations in the forward and backward directions are cancelled each other and vibrations in the leftward and rightward directions as seen in the drawing are superimposed each other.

On the other hand, in the embodiment as illustrated in FIG. 6 eccentric masses 20A and 20B on the rotary shafts 17A and 17B are located in the opposite phase to eccentric masses 20E and 20F on the rotary shafts 17C and 17D. Thus, as the rotary shafts 17A, 17B, 17C and 17D are rotated by means of the hydraulic motor 13, circular movement in the horizontal plane caused by rotation of the eccentric masses 20A and 20B cooperate with circular movement in the horizontal plane caused by rotation of the eccentric masses 20E and 20F in such a manner that vibrations in the leftward and rightward direction are cancelled each other and vibrations in the forward and backward directions as seen in the drawing are superimposed each other.

In addition the vibrating mechanism of the invention for generating vibrations in the horizontal plane may be operatively associated with a vibrating mechanism particularly for generating vibrations in the vertical direction in order that vibrations in both the directions can be selectively utilized by operating a clutching means as required.

As will be readily understood from the above description, a ground compacting machine with a vibrating mechanism as constructed in the above-mentioned manner mounted thereon performs rolling operation using vibrations in the horizontal direction and thereby advantageous features such as high operational efficiency, reduced adverse influence on the circumstances due to vibration, high apparent frictional coefficient relative to the ground surface and others are assured by the vibrating mechanism of the invention.

What is claimed is:

1. In a mechanism for generating vibrations for a ground compacting machine of the type including a rolling wheel, the improvement consisting in that at least one rotary shaft with an eccentric mass fixedly mounted thereon is rotatably supported in the rolling wheel in such a manner that the center line of rotation of said rotary shaft is located on a linear line extending in parallel with the radial direction relative to the center line of rotation of the rolling wheel whereby the ground contact portion on the rolling wheel is vibrated in the horizontal plane by rotating the rotary shaft for the eccentric mass.

2. A mechanism for generating vibrations for a ground compacting machine as defined in claim 1, wherein the rotary shaft assumes the position in the rolling wheel where the center line of rotation thereof is located on a radial line extending outwardly from the center line of rotation of the rolling wheel.

3. A mechanism for generating vibrations for a ground compacting machine as defined in claim 1, wherein two or more rotary shafts with eccentric masses fixedly mounted thereon are rotatably supported in the rolling wheel.

4. A mechanism for generating vibrations for a ground compacting machine as defined in claim 3, wherein the rotary shafts are positioned in the rolling wheel such that their center lines of rotation are located on radial lines extending outwardly from the center line of rotation of the rolling wheel.

5. A mechanism for generating vibrations for a ground compacting machine as defined in claim 3, wherein the rotary shafts are positioned in the rolling wheel such that their center lines are located in the spaced relation in the axial direction of the center line of rotation of the rolling wheel.

6. A mechanism for generating vibrations for a ground compacting machine as defined in claim 1, wherein the rolling wheel is made of rigid material and is covered with a layer of coating of elastomeric material such as rubber or the like over the whole circumferential surface thereof.

* * * * *